US005730694A

United States Patent [19]

Hagleitner

[11] Patent Number: 5,730,694

[45] Date of Patent: Mar. 24, 1998

[54] CONTAINER OF THERMOPLASTIC MATERIAL AND PROCESS FOR THE PRODUCTION THEREOF

[75] Inventor: Hans Georg Hagleitner, Zell am See, Austria

[73] Assignee: Hagleitner Betriebshygiene Gesellschaft m.b.H. & Co. KG, Zell am See, Austria

[21] Appl. No.: 619,709

[22] PCT Filed: Sep. 26, 1994

[86] PCT No.: PCT/AT94/00137

§ 371 Date: Mar. 28, 1996

§ 102(e) Date: Mar. 28, 1996

[87] PCT Pub. No.: WO95/09111

PCT Pub. Date: Apr. 6, 1995

[30] Foreign Application Priority Data

Sep. 28, 1993 [AT] Austria ..... 1956/93

[51] Int. Cl.[6] ..... B31B 1/64; B31B 1/90; D65D 8/22

[52] U.S. Cl. ..... 493/108; 493/210; 220/613; 220/680

[58] Field of Search ..... 220/611, 612, 220/613, 666, 667, 678, 253, 351, 680; 493/102, 210, 237, 346, 381, 255, 308, 288, 287, 108, 196, 212, 213

[56] References Cited

U.S. PATENT DOCUMENTS

| | | | |
|---|---|---|---|
| 988,116 | 3/1911 | Lee et al. | 220/351 X |
| 1,156,619 | 10/1915 | Neel | 493/288 X |
| 2,039,255 | 4/1936 | Marland | 220/612 |
| 2,194,451 | 3/1940 | Soubier | 493/210 X |
| 2,584,095 | 1/1952 | Slaughter | 220/613 X |
| 3,434,627 | 3/1969 | Tebbutt | 220/611 |
| 3,606,726 | 9/1971 | Spertus et al. | 493/288 X |
| 3,874,558 | 4/1975 | Rockefeller | 220/613 X |
| 4,021,342 | 5/1977 | Schacht et al. | 220/611 X |
| 4,060,179 | 11/1977 | McGhie | 220/613 X |
| 4,356,926 | 11/1982 | Priestly et al. | 220/613 X |
| 5,027,963 | 7/1991 | Robbins, III | 220/666 X |

FOREIGN PATENT DOCUMENTS

| | | |
|---|---|---|
| 0069249 | 1/1983 | European Pat. Off. . |
| 0874080 | 7/1942 | France . |
| 2482564 | 11/1981 | France . |
| 3119257 | 12/1982 | Germany . |
| 1578260 | 11/1980 | United Kingdom . |
| 8403873 | 10/1984 | WIPO . |

*Primary Examiner*—Allan N. Shoap
*Assistant Examiner*—Niki M. Kopsidas
*Attorney, Agent, or Firm*—Lorusso & Loud

[57] ABSTRACT

A container made of thermoplastic material has a bottom, a lid and a wall that extends between the bottom and the lid. The wall is substantially less thick than the bottom and the lid and is designed as a film soldered along a longitudinal seam and welded to the bottom and the lid.

2 Claims, 5 Drawing Sheets

CONTAINER OF THERMOPLASTIC MATERIAL AND PROCESS FOR THE PRODUCTION THEREOF

The invention concerns a container of thermoplastic material and a process for the production thereof.

A container of that kind is to be found for example in EP-A-483 976. The screw closure plastic bottle described therein has a handle and is produced from a tubular element by a blow molding process. The thickness of the central wall portion is about one third to one quarter of the thickness of the bottom and the cover portion.

If the container is to be provided with labelling or marking, a label is applied to the container or is introduced into the blow molding mold.

EP-A-126 575 shows a screw closure plastic bottle which is composed of a bottom, a peripheral portion and a cap, and whose peripheral portion represents an extruded and in particular multi-layer tube portion to which the bottom and the cap are latched and then welded. The problem of labelling or marking is not solved thereby.

The object of the present invention is to provide a container whose central wall portion can be directly printed upon so that there is no need to apply labels.

In accordance with the invention that object is attained in that the wall portion comprises a film welded along a longitudinal seam, and is welded to the bottom and to the cover portion. Producing the central region of the container from a flat film makes it possible to apply printing to the major part of the film in any manner, as the subsequent container production procedure only involves processing the film at the edges thereof but not at the printed region thereof. Both the operation of welding the longitudinal seam and also the operation of welding to the bottom and the cover portion require only heating a narrow strip in each case.

A preferred embodiment provides that the bottom and the cover portion each have a flange to which the wall portion is welded.

The flange is arranged in each case at the same side, namely at the inside of the container in the case of the cover portion and at the outside in the case of the bottom. The similar configuration involved makes it possible for the cover portion and the bottom to be successively connected to the wall portion by means of a single transverse welding device.

For use of the container as a refill pack in soap dispensers or the like, it is further provided that the cover portion has a container neck with a push-on guide means, open at least towards one side, for a sliding closure. In that way the container can be inserted into the dispenser from the side.

A preferred process for the production of containers according to the invention provides that a flat film, in particular with printing thereon, is closed to form a tubular portion and welded along the two longitudinal edges, that a cover portion and a bottom are introduced alternately into the closing tubular portion and respectively welded in the already closed region to the tubular portion, and that then each container is cut off. In that procedure the flat film is fed by way of a mold shoulder and corresponding guide elements to a thin-wall tube which forms a core and which serves as a co-operating holder for the welding device which produces the longitudinal seam and which acts from the outside. As preferably each container is produced in advance with the cover portion, a first cover portion is fed through the core tube from a magazine, the closable opening of the cover portion facing in the feed direction, so that the feed tool which preferably at the same time forms an internal cooperating holder for the transverse seam welding operation can engage within the flange of the cover portion. After the dover portion has been pushed through the core tube, the cover portion is welded to the tubular portion for forming the container. The forward feed movement of the tubular portion for forming the container and the longitudinal welding operation are continued and the co-operating holder is retracted from the cover portion through the core tube again. The forward feed length of the tube portion for the container, as it is being formed, which length determines the filling volume of the container, is controlled for example by the detection of markings which are printed on to the film. Finally, a bottom is fed from a magazine through the core tube by means of the feed tool, in which step the flange thereof is also disposed at the side facing towards the feed tool, which represents the later outward side of the container. The co-operating holder of the feed tool can therefore also support the bottom. The forward feed movement of the film is stopped again and the tubular portion for forming the container is welded to the bottom. The tubular portion is now cut off and a finished container is ejected. A further cover portion is supplied from the magazine and welded to the tubular portion for forming the container and the next container is produced in the described manner.

The invention will now be described in greater detail with reference to the Figures in the drawings, without being restricted thereto.

Figure 1:
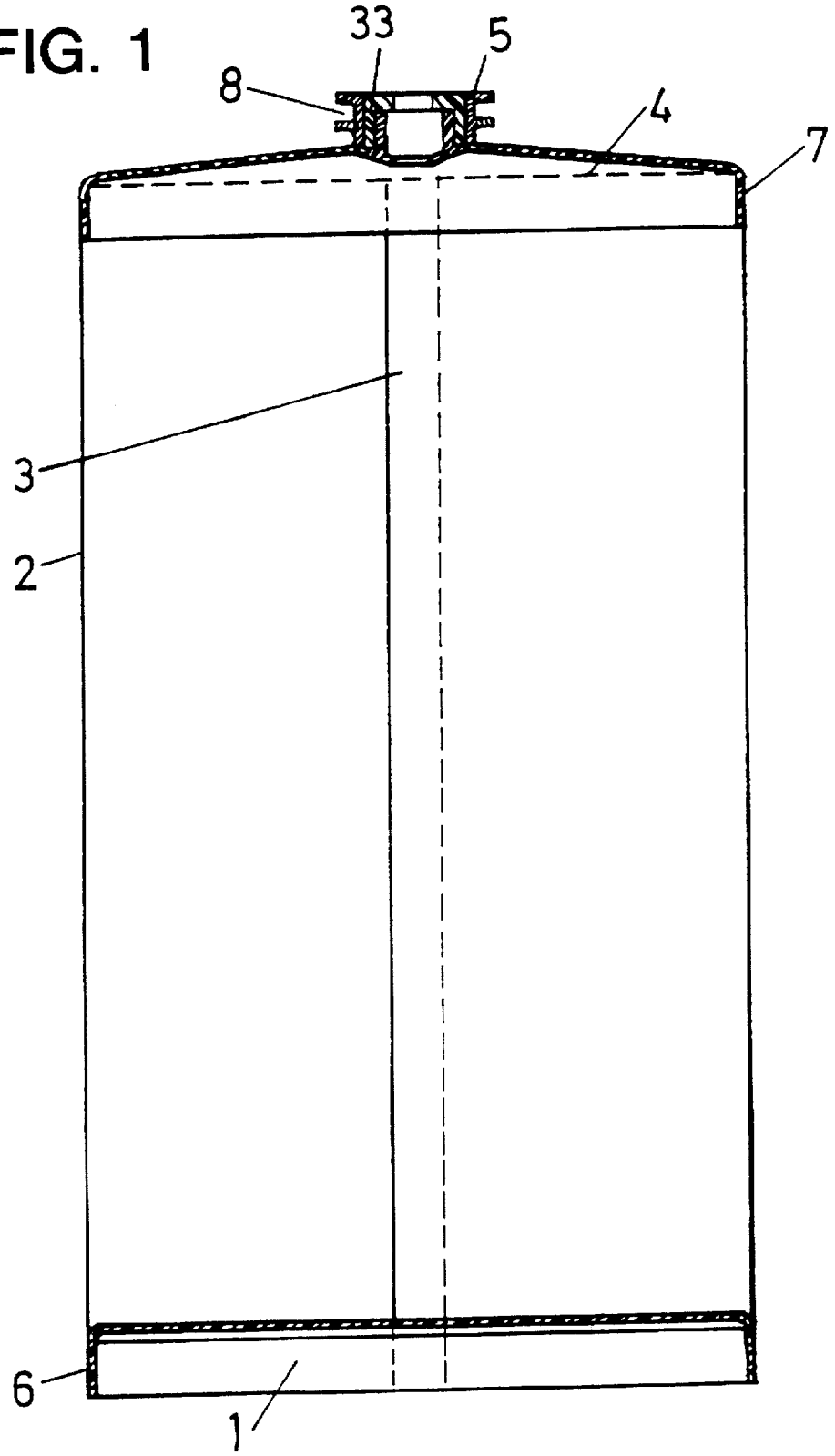
FIG. 1 is a view in longitudinal section through a container.
Figure 2:
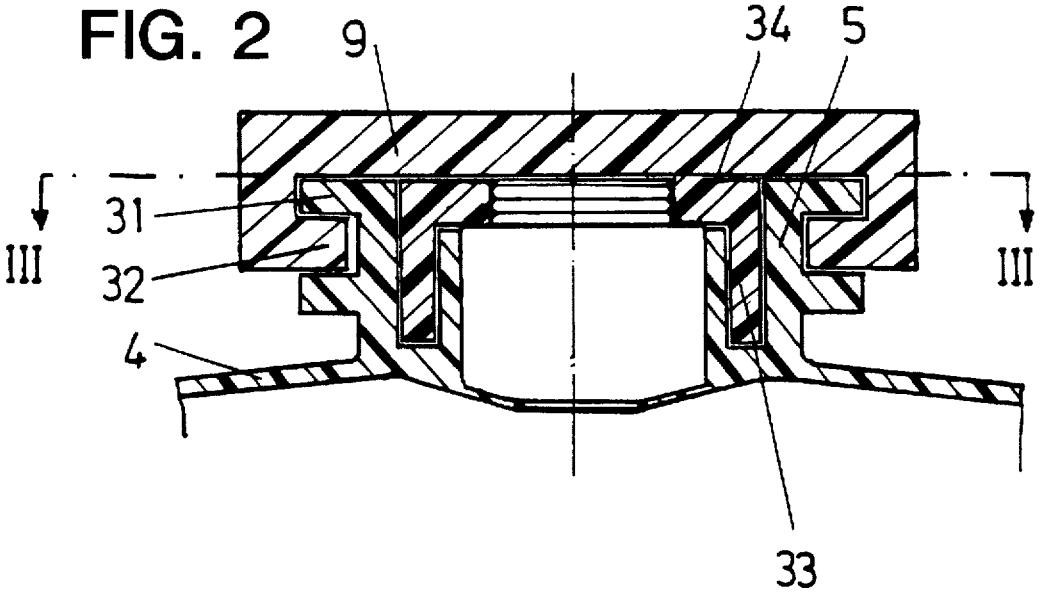
FIG. 2 is a view in section through the closed cover portion.
Figure 3:
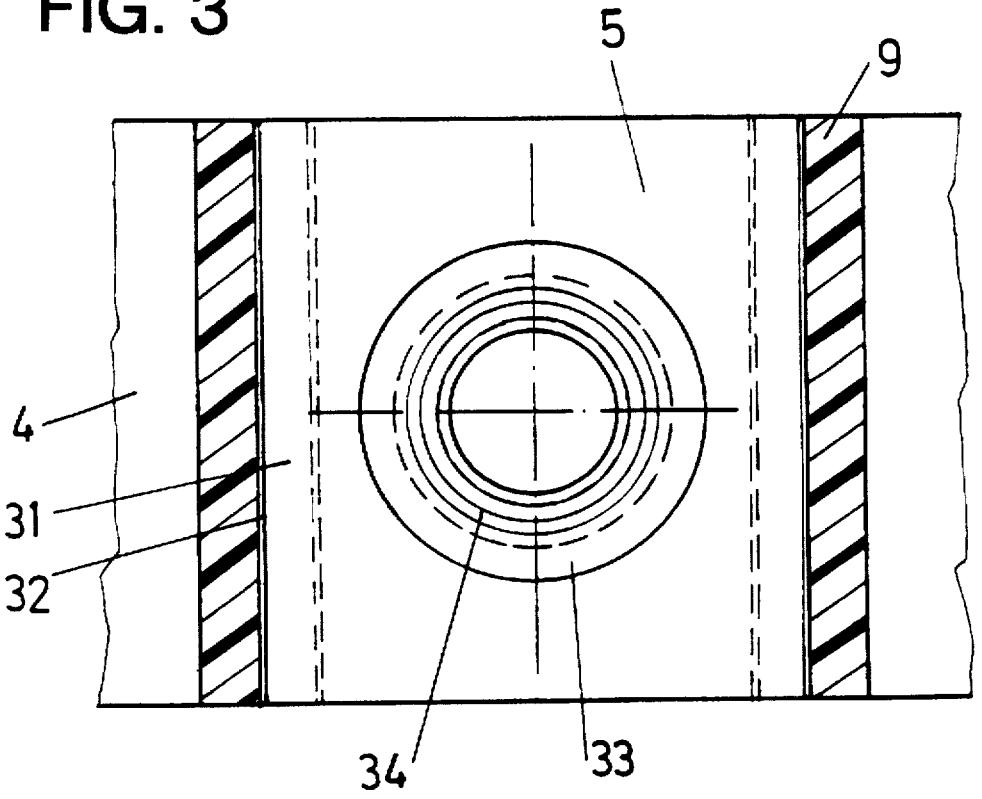
FIG. 3 is a view in section taken along line III—III in FIG. 2.

A container has a bottom 1 comprising in particular polyethylene, with a downwardly outwardly projecting flange 6. A wall portion 2 comprising a film is welded to the flange 6. The thickness of the film is preferably between 0.08 mm and 0.1 mm. At the upper end the wall portion 2 is welded to a flange 7 of a cover portion 4. The opening of the container is provided in an upstanding container neck 5 which is provided with a push-on guide means 8 for a sliding closure 9 which can be pushed on from the side. Fitted into an annular groove in the container neck 5 is a sealing insert 33 which has upstanding annular limb portions 34 at the top side. The sliding closure 9 engages with inwardly directed limb portions 32 under side flanges 31 of the container neck 5. A limit abutment (not shown) may be provided to restrict the depth of sliding movement.

The wall portion 2 is produced from a flat film and therefore has a longitudinal welded seam 3. The flat film web is preferably printed upon so that there is no need to apply a label to the container. The closed container which is filled for example with liquid soap is capable of standing as it is only in the upright position that it is at its largest volume and because of the small thickness of the film, upon emptying, it collapses into itself so that its empty volume is reduced to a minimum size. The thickness of the bottom 1 and the cover portion 4 is preferably between 0.6 and 0.8 mm.

Figure 4:
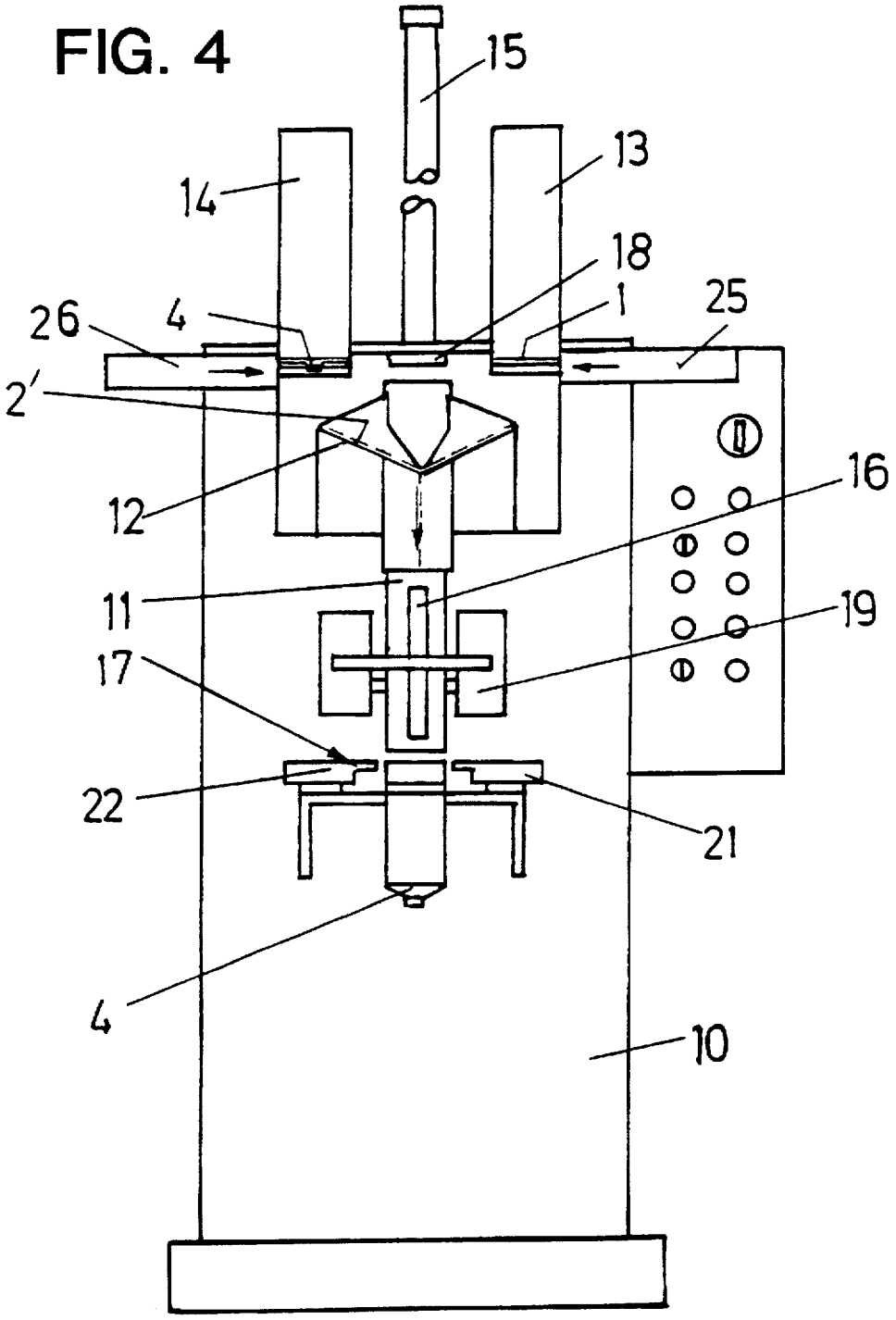
FIG. 4 is a diagrammatic front view of a production apparatus.
Figure 5:
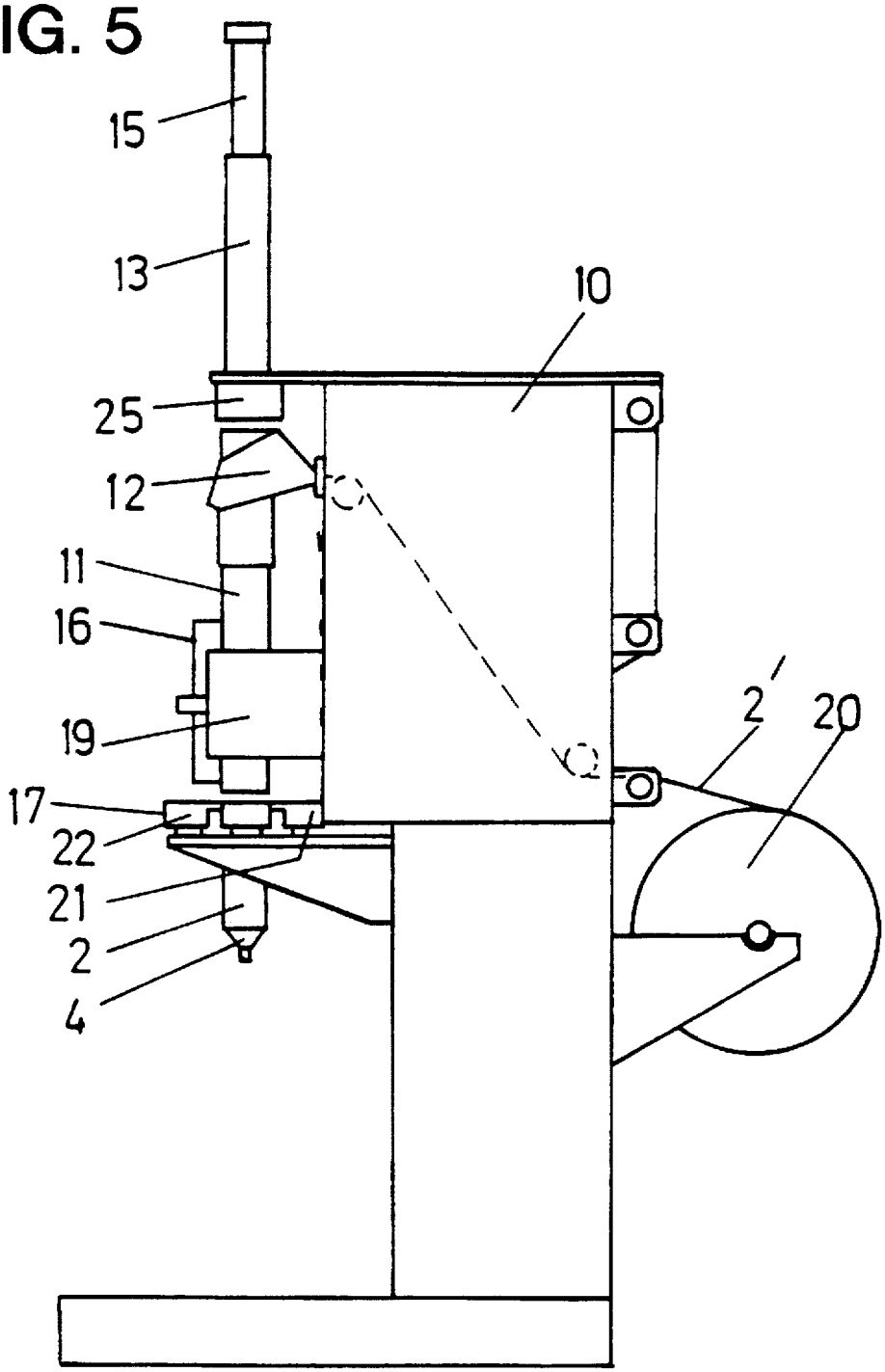
FIG. 5 is a diagrammatic side view of the production apparatus.
Figure 6:
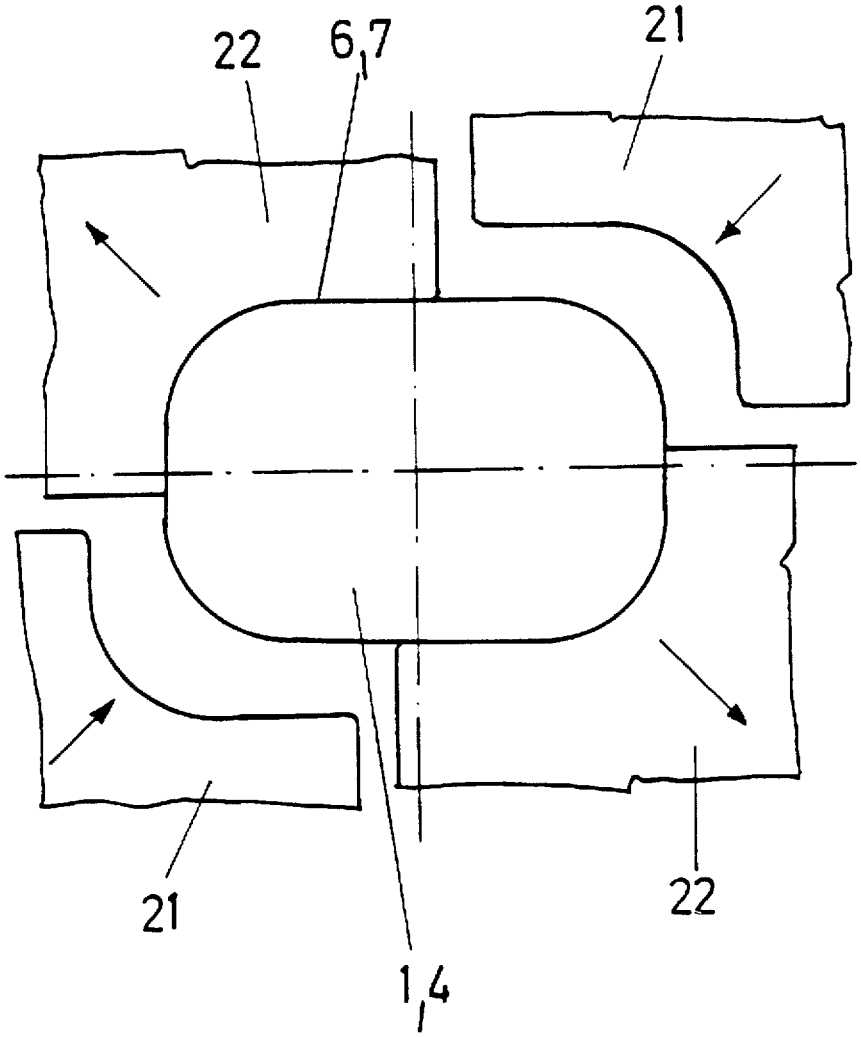
FIG. 6 is a diagrammatic plan view of the transverse seam welding device shown in FIG. 1.

A production apparatus 10 as shown in FIGS. 4 through 6 has a thin-wall tube 11 which forms a mold core and to which a flat film 2' in particular with printing thereon, is fed from a roll 20. The film 2' passes over a mold shoulder 12 to the core tube 11 and is closed around same to form a tubular portion, passing a longitudinal welding device 16 whose co-operating holder is formed by the core tube 11. Provided laterally of a feed device 15 is a magazine 13 for bottoms 1 and a magazine 14 for cover portions 4. Transverse displacement devices 25 and 26 provide for alternately pushing a cover portion 4 out of the magazine 14 and a bottom 1 out of the magazine 13, into a position in front of the feed device 15 which has an internal co-operating holder 18. The latter engages the respectively forwardly pushed portion within the flange 6, 7 and guides it through the core tube 11 to a transverse welding device 17 which is arranged beneath the core tube 11 and which welds the tubular portion for forming the container firstly to a cover portion 4 and then to a bottom 1. The transverse welding device 17 is provided with a cutting device which cuts off the tubular portion along each bottom 1, so that a container is ejected. The length of the tubular portion for forming the container, which determines the filling volume, is controlled by a forward feed device 19 which for example has a sensor for detecting printed markings. The cross-section of the container may be of any desired configuration. For a cross-section which is of a rounded-off rectangular configuration, the transverse welding device 17 can be of the design shown for example in FIG. 6. It has welding jaws 21, 22 each associated with a respective quadrant which are urged alternately in the diagonals displaceably from the outside against the regions, which are to be welded, of the wall portion 2 and of the bottom 1 and the cover portion 4 respectively, which are supported against the cooperating holder 18, which is disposed in the interior, of the feed device 15. The co-operating holder 18 may possibly be composed of spreadable individual elements.

I claim:

1. A process for the production of a container of thermoplastic material, having a bottom portion, a cover portion having an opening, and a wall portion which extends between the bottom and the cover portions and which is of a substantially smaller thickness than the bottom and the cover portions, said process comprising closing a flat film having two longitudinal edges to form a tubular wall portion and welding along the two longitudinal edges, introducing a cover portion and a bottom portion alternately into the closing tubular portion, welding each of said cover portion and bottom portion in the already closed region to the tubular wall portion, and cutting off the closed tubular portion between a bottom portion and a following cover portion.

2. A process according to claim 1, wherein said bottom portion has a first circumferential flange, and said cover portion has a second circumferential flange, said first and second flanges being oriented in the same direction.

* * * * *